US009583866B2

(12) United States Patent
Chen et al.

(10) Patent No.: US 9,583,866 B2
(45) Date of Patent: Feb. 28, 2017

(54) RECEPTACLE CONNECTOR CAPABLE OF MATING WITH PLUG CONNECTORS WITH METAL CASES WITH DIFFERENT LENGTHS

(71) Applicant: SPEED TECH CORP., Taoyuan (TW)

(72) Inventors: Chih-Cheng Chen, Taoyuan (TW); I-Ting Hsieh, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 15/071,214

(22) Filed: Mar. 16, 2016

(65) Prior Publication Data

US 2016/0276774 A1 Sep. 22, 2016

(30) Foreign Application Priority Data

Mar. 20, 2015 (TW) ..... 104204297 U

(51) Int. Cl.

| | |
|---|---|
| ***H01R 25/00*** | (2006.01) |
| ***H01R 13/62*** | (2006.01) |
| ***H01R 13/514*** | (2006.01) |
| ***H01R 31/06*** | (2006.01) |
| ***H01R 13/6581*** | (2011.01) |

(52) U.S. Cl.

CPC ..... *H01R 13/514* (2013.01); *H01R 13/6581* (2013.01); *H01R 31/06* (2013.01)

(58) Field of Classification Search

CPC ..... H01R 13/62; H01R 25/00; H01R 27/00; H01R 31/00; H01R 31/06; H01R 24/54; H01R 33/00; H01R 33/22; H01R 33/88; H01R 33/94; H01R 33/97

USPC ..... 439/638, 300

See application file for complete search history.

(56) References Cited

U.S. PATENT DOCUMENTS

| | | | | |
|---|---|---|---|---|
| 2015/0244111 | A1* | 8/2015 | Ju | H01R 13/6585 439/607.05 |
| 2016/0134055 | A1* | 5/2016 | Chen | H01R 12/722 439/217 |
| 2016/0134056 | A1* | 5/2016 | Chen | H01R 13/642 439/217 |
| 2016/0149348 | A1* | 5/2016 | Kao | H01R 13/6585 439/607.05 |
| 2016/0149350 | A1* | 5/2016 | Kao | H01R 24/60 439/607.05 |

* cited by examiner

*Primary Examiner* — Chandrika Prasad

(74) *Attorney, Agent, or Firm* — CKC & Partners Co., Ltd.

(57) ABSTRACT

A receptacle connector includes a connector body at least suitable to mate with a plug connector having an insulating housing and a metal case. The metal case encompasses the outside of the insulating housing, and the metal case is made of a suitable metallic material. The connector body includes a plurality of metal terminals and a plastic base. The plastic base includes at least a tongue plate for the metal terminals to interpose therein. The plastic base forms a circumferential gap near a region in the vicinity of the tongue plate. The circumferential gap defines an accommodation space. When the receptacle connector and the plug connector are mated, the metal case at least partially encompasses the outside of the tongue plate. When the receptacle connector and another plug connector with a longer metal case are mated, the longer metal case is accommodated in the circumferential gap.

3 Claims, 14 Drawing Sheets

RECEPTACLE CONNECTOR CAPABLE OF MATING WITH PLUG CONNECTORS WITH METAL CASES WITH DIFFERENT LENGTHS

RELATED APPLICATIONS

This application claims priority to Taiwanese Application Number 104204297, filed Mar. 20, 2015, which is herein incorporated by reference.

BACKGROUND

Technical Field

The present disclosure relates to connector combinations. More particularly, the present disclosure relates to connector combinations including a receptacle connector capable of mating with plug connectors with mating heads of different lead-in lengths.

Description of Related Art

In general, bus connectors of a computer are required to be expanded as the communication interface for information transmission between the internal elements in the system. PCI Express (PCIe) bus connectors are the most common expanding bus connector in computers. Since a PCIe bus connector has a relatively higher maximum throughput and a minimum input/output pin counts (I/O pin count), PCIe bus connectors have become the main stream of the bus connectors of computer systems. In recent years, the Peripheral Component Interconnect Special Interest Group (PCI-SIG) has launched a cable system following the PCIe specifications, known as the PCIe Oculink cables. The PCIe Oculink cables can be regarded as an extension of the PCIe bus connectors. The PCIe Oculink cables can be connected to different storage devices inside a computer, and can be utilized outside a computer to connect various devices supporting the PCIe specifications to the computer.

Please refer to FIG. 1. FIG. 1 is a perspective view of a traditional PCI Express (PCIe) Oculink connector assembly. As shown in FIG. 1, a PCIe Oculink board end double layers connector combination 100 includes a receptacle connector 118 and two plug connectors 112, 114. Please also refer to FIG. 2. FIG. 2 is an exploded view of the plug connector of FIG. 1. As shown in FIGS. 1-2, the plug connectors of the traditional PCIe Oculink connector assembly include two plug connectors 112, 114, an external steel case 110 and a spacer 212. The spacer 212 is utilized as the back plate supporting the plug connectors 112, 114, so as to strengthen the mechanical stability of the plug connectors 112, 114. The external steel case 110 covers outside the plug connectors 112, 114, configured to fix and plug together the plug connectors 112, 114. The plug connectors 112, 114 are respectively connected to the cables 124, 126. The plug connectors 112, 114 respectively include a plug body 112*c*, 114*c*, and an upper metal cover 112*a*, 114*a*, and a lower metal cover 112*b*, 114*b*, respectively configured to cover the plug bodies 112*c*, 114*c*. The plug bodies 112*c*, 114*c* respectively have an insulating housing 211, 213, and a plurality of metal terminals 214, 215, in which the metal terminals 214, 215 are respectively interposed inside the insulating housings 211 and 213. The metal terminals 214, 215 are divided into the upper and the lower rows respectively disposed on the upper surface and the lower surface inside the insulating housing 211, 213, in which each of the rows has 21 metal terminals. The plug bodies 112*c*, 114*c* further include a steel case 216, 217, configured to accommodate the insulating housings 211, 213. The portion of the steel cases 216, 217 protruding from the upper metal covers 112*a*, 114*a* and the lower metal covers 112*b*, 114*b* form a mating head 216*a*, 217*a* having an inner hollow space to mate with the plug connector 118. Please be noted that, in this specification, similar elements are presented by the same marking number.

Please also refer to FIG. 3. FIG. 3 is an exploded view of the receptacle connector of FIG. 1. As shown in FIGS. 1 and 3, a traditional PCIe Oculink receptacle connector 118 includes an external metal case 118*a* and a connector body 118*b*. The external metal case 118*a* is configured to cover the connector body 118*b*. The connector body 118*b* includes a plastic base 300 and a plurality of metal terminals 306, in which the plastic base 300 includes an upper tongue plate 302 protruding forwards from an upper region of the front portion of the plastic base 300, and a lower tongue plate 304 protruding forwards from a lower region of the front portion of the plastic base 300. The metal terminals 306 are respectively interposed into the grooves on the upper surface and the lower surface of the tongue plates 302, 304, such that two receiving grooves are formed at the front portion of the receptacle connector 118. The mating head 216*a* is configured to insert into the receiving groove where the tongue plate 302 is located, and the mating head 217*a* is configured to insert into the receiving groove where the tongue plate 304 is located. When the receptacle connector 118 is mated with the plug connectors 112, 114, through the snapping of the of the groove 307 on a side of the tongue plate 302 and a corresponding groove (not shown) on a side of the insulating housing 211, 213, the receptacle connector 118 and the plug connectors 112, 114 are fixed, such that the mating heads 216*a*, 217*a* abut against the plastic base 300, as shown in FIGS. 1 and 3.

In general, the lead-in lengths of the mating heads 216*a*, 217*a* of the standard PCIe Oculink plug connectors 112, 114 are subject to strict specifications. Please refer to FIG. 4A. FIG. 4A is a perspective view of a standard PCIe Oculink plug connector. As shown in FIG. 4A, the lead-in lengths d1 of the mating heads 216*a*, 217*a* of the standard PCIe Oculink plug connectors 112, 114 are 5.95 mm. However, when the PCIe Oculink plug connector is to be applied to the outside of a computer, since the lead-in lengths of the mating heads 216*a*, 217*a* are often too shallow, the plug connectors 112, 114 are easily collided or flipped and the problem of supporting failure is produced. Please refer to FIG. 4B. FIG. 4B is a perspective view of an elongated PCIe Oculink plug connector. If the lead-in lengths of the mating heads 216*a*, 217*a* or the metal cases 216, 217 are increased, as shown in FIG. 4B, the lead-in lengths of the mating heads 216*a*', 217*a*' of the PCIe Oculink plug connectors 112', 114' are d2 (for example, 8.45 m), the tolerability of the plug connectors 112', 114 against stress can be strengthened, such that the PCIe Oculink connectors are suitable to be used outside a computer. However, due to the extension of the lead-in lengths of the mating heads 216', 217' of the elongated PCIe Oculink plug connectors 112', 114', the elongated PCIe Oculink plug connectors 112', 114' cannot be successfully mated with the receptacle connector 118. Thus, such prior art requires improvement.

SUMMARY

A technical aspect of the present disclosure provides a receptacle connector capable of mating with plug connectors with different lead-in lengths.

According to an embodiment of the present disclosure, a receptacle connector includes a connector body. The connector body includes a plurality of metal terminals and a plastic base. The plastic base includes at least a tongue plate for the metal terminals to interpose therein. The plastic base forms a circumferential gap near a region in the vicinity of the tongue plate. The circumferential gap defines an accommodation space. When the receptacle connector and a plug connector with a longer metal case are mated, a mating head of the plug connector is allowed to be accommodated therein, such that the receptacle connector can be mated with the plug connector with the longer metal case or a standard plug connector.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
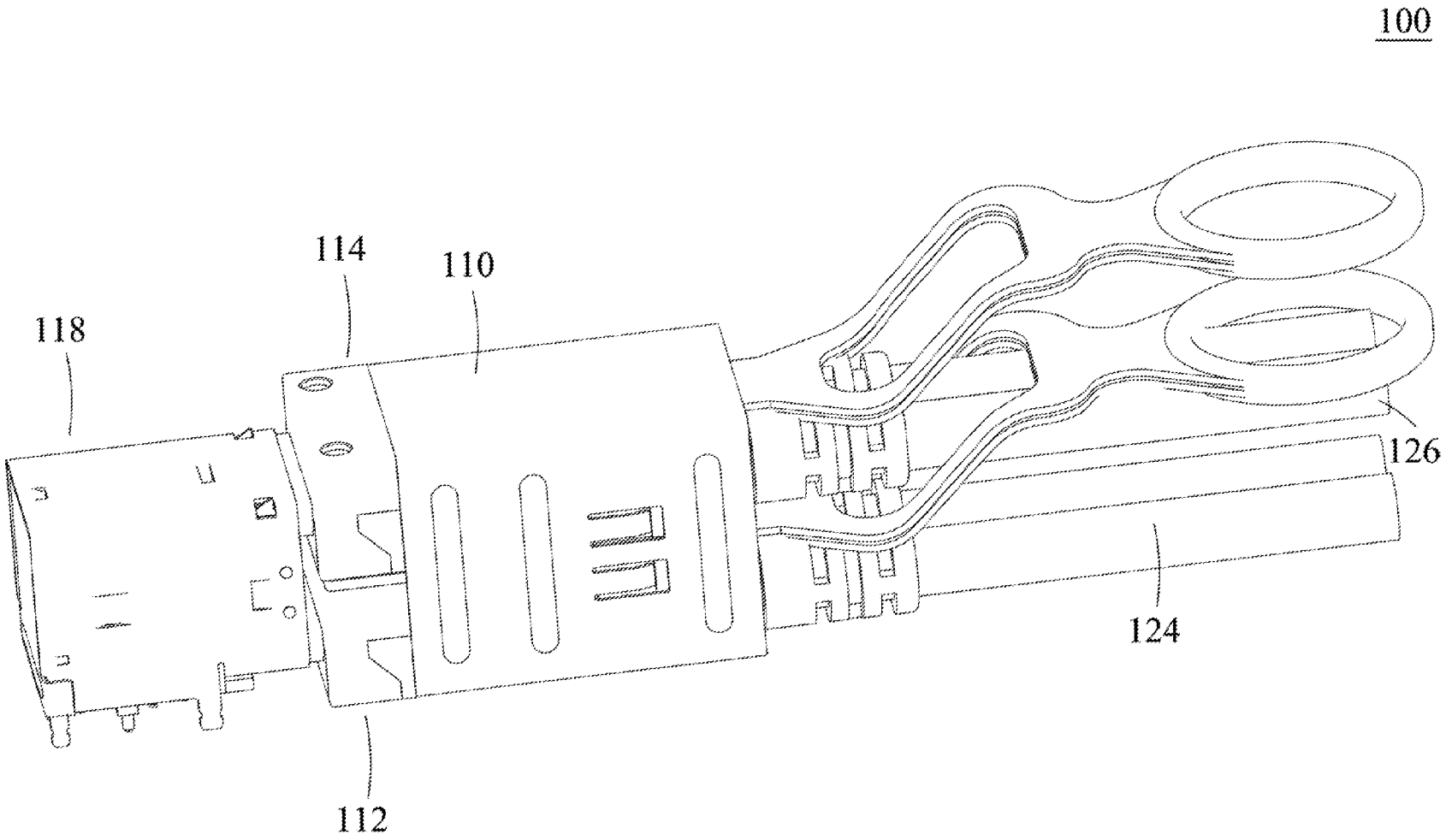
Fig. 1 ( PRIOR ART )
FIG. 1 is a perspective view of a traditional PCI Express (PCIe) Oculink connector assembly.
Figure 2:
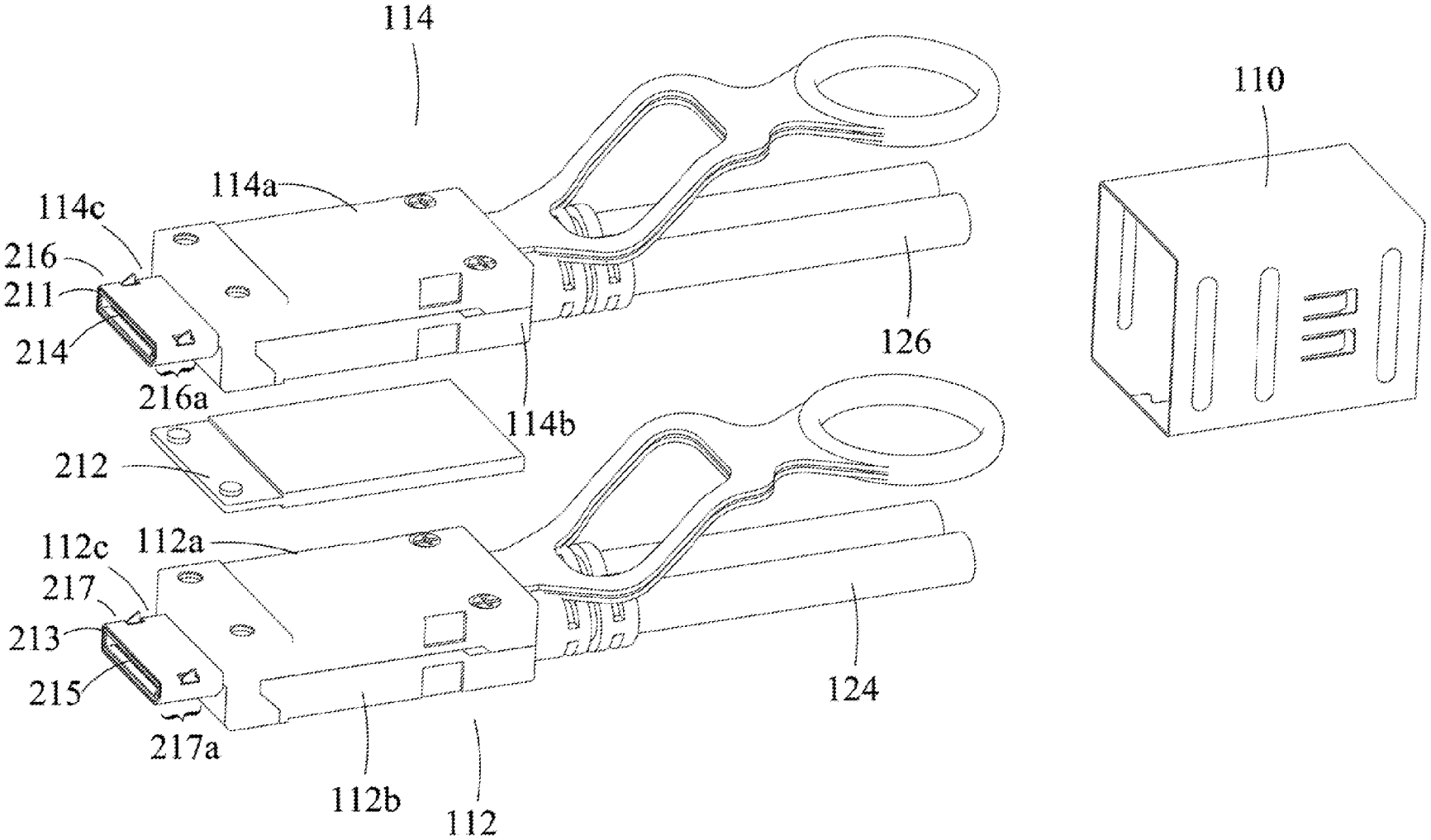
Fig. 2 ( PRIOR ART )
FIG. 2 is an exploded view of the plug connector of FIG. 1.

Drawings will be used below to disclose a plurality of embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 3:
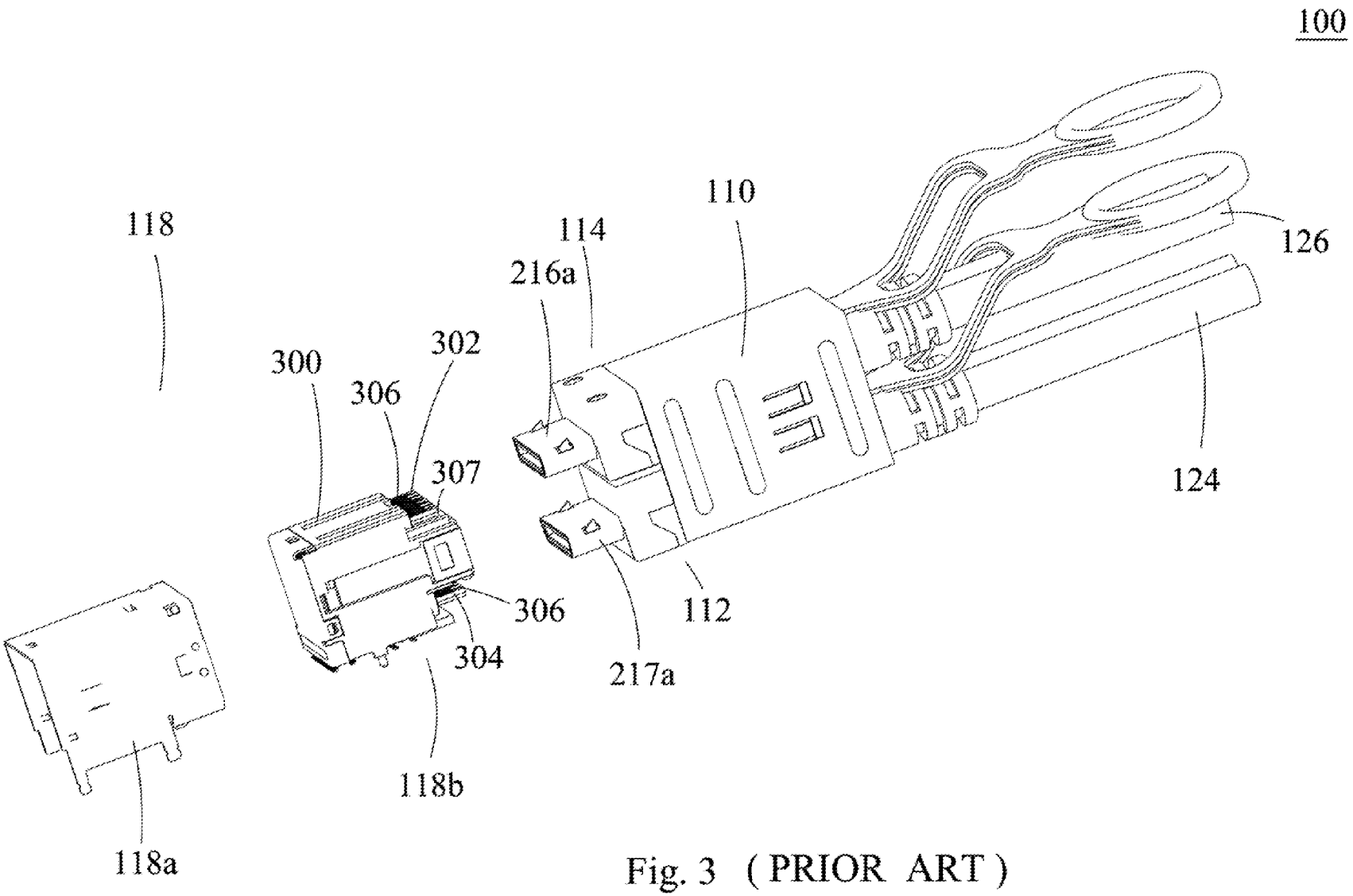
Fig. 3 (PRIOR ART)
FIG. 3 is an exploded view of the receptacle connector of FIG. 1.
Figure 4A:
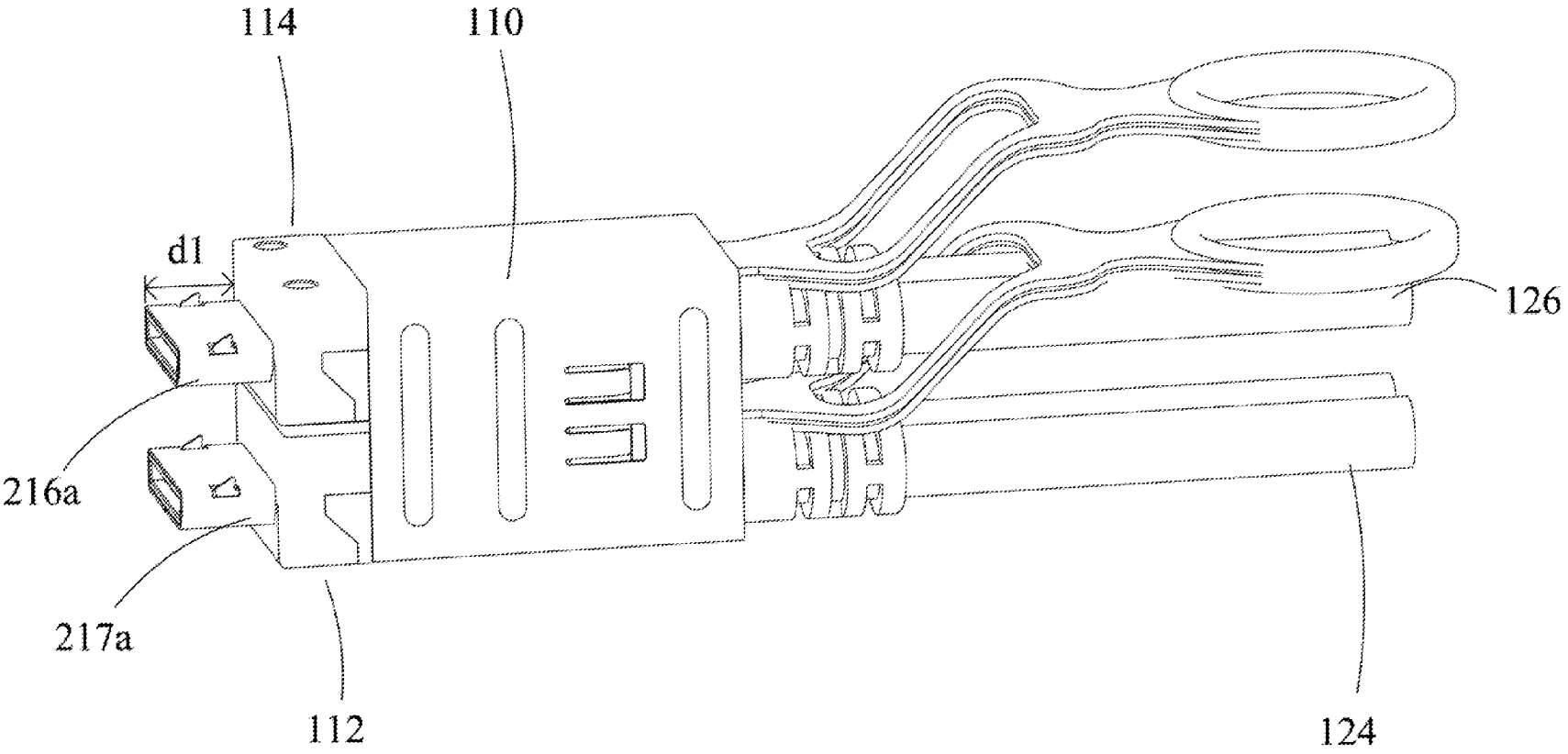
Fig. 4A (PRIOR ART)
FIG. 4A is a perspective view of a standard PCIe Oculink plug connector.
Figure 4B:
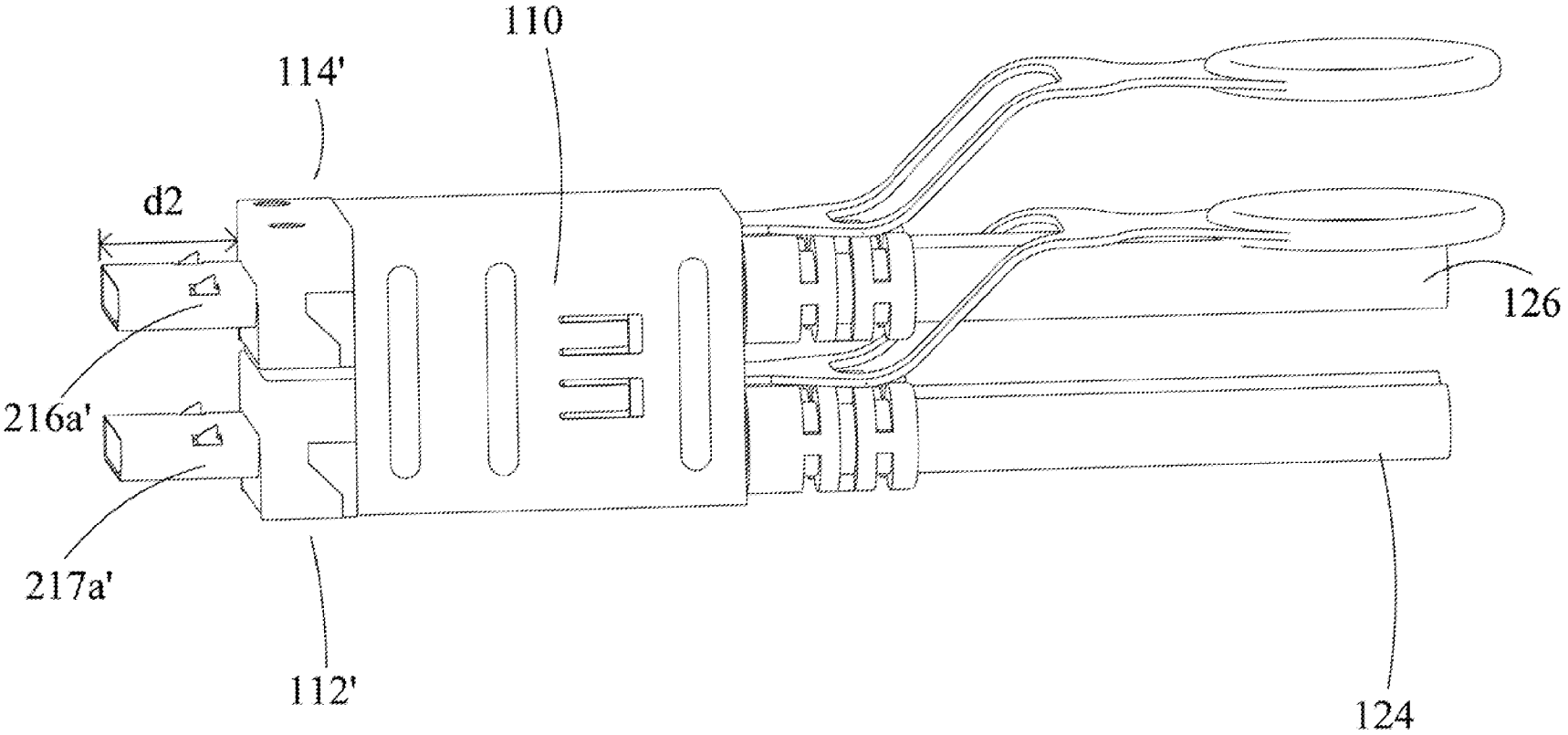
Fig. 4B (PRIOR ART)
FIG. 4B is a perspective view of an elongated PCIe Oculink plug connector.
Figure 5:
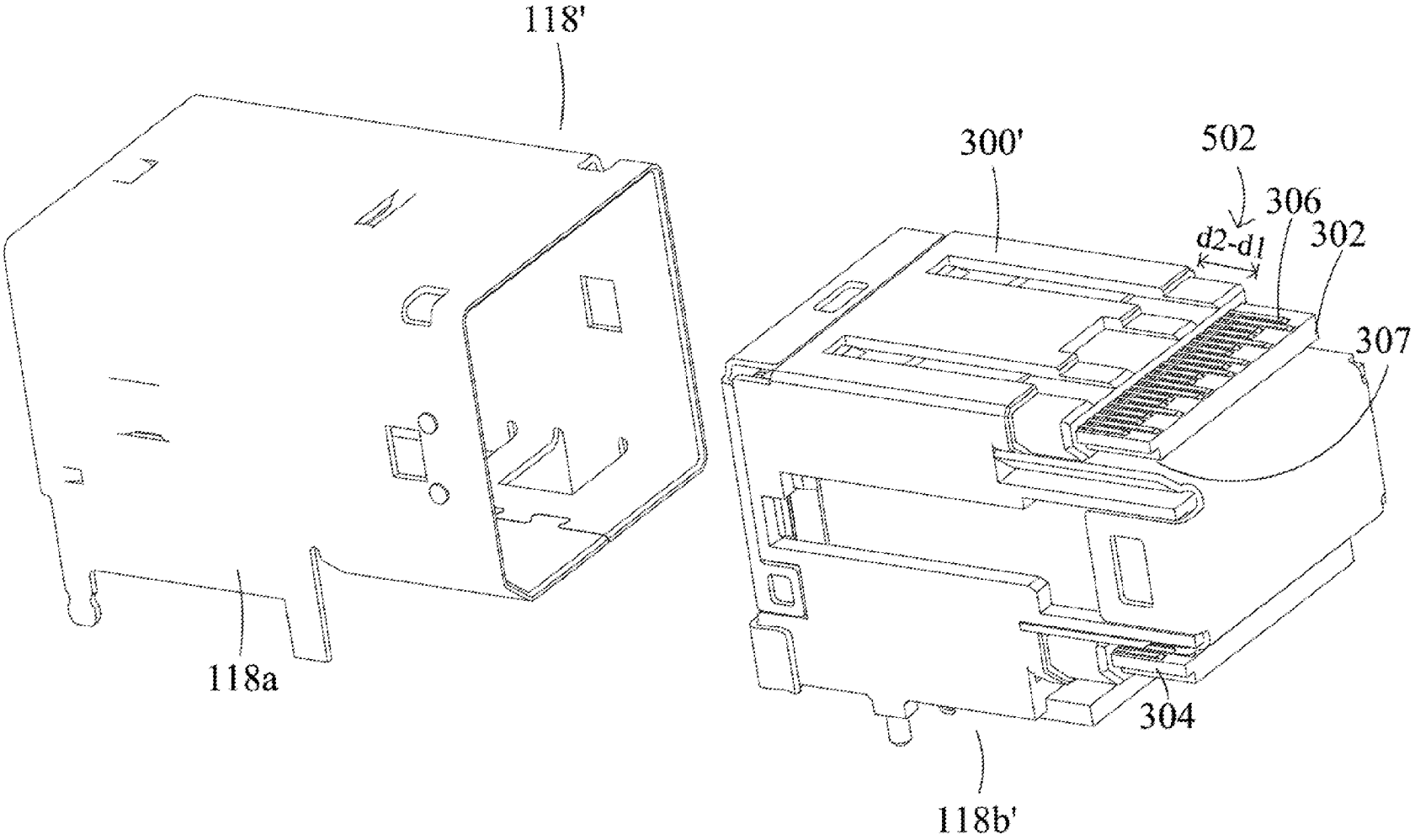
FIG. 5 is a perspective view of a receptacle connector according to an embodiment of the present disclosure.

Please refer to FIG. 5. FIG. 5 is a perspective view of a receptacle connector 118' according to an embodiment of the present disclosure. As compared between the receptacle connector 118' of FIG. 5 of the present disclosure and the traditional receptacle connector 118 of FIG. 3, it can be seen that in the present disclosure, a circumferential gap 502 is formed by an excavation of a part of the plastic material of the plastic base 300' of the connector body 118*b*' of the receptacle connector 118' near a region in the vicinity of the tongue plate 302, 304, so as to define an accommodation space to accommodate the elongated section of the mating heads 216*a*', 217*a*' of the elongated plug connectors 112', 114'. The excavation refers to the removal or the lack of a part of plastic material, and the excavation does not limit to the processing after the formation of the plastic base 300'. During the formation of the plastic base 300', making the plastic base 300' to be lacking a part of the plastic material is also classified as excavation in the present disclosure.

In the present disclosure, the length of the circumferential gap 502 is approximately equal to the lead-in lengths d2 of the metal case of the elongated plug connectors 112', 114' or the mating heads 216*a*', 217*a*' minus the lead-in lengths d1 of the mating heads 216*a*, 217*a* of the standard plug connector 112, 114. This means the length of the circumferential gap 502 is approximately equal to d2−d1. The width of the circumferential gap 502 is approximately equal to the width of the plastic base 300', and the height of the circumferential gap 502 is approximately equal to the thickness of the mating heads 216*a*, 217*a* and the mating heads 216*a*', 217*e*. Therefore, the receptacle connector 118' can be freely mated with the standard plug connectors 112, 114 or the elongated plug connectors 112', 114'.

Figure 6A:
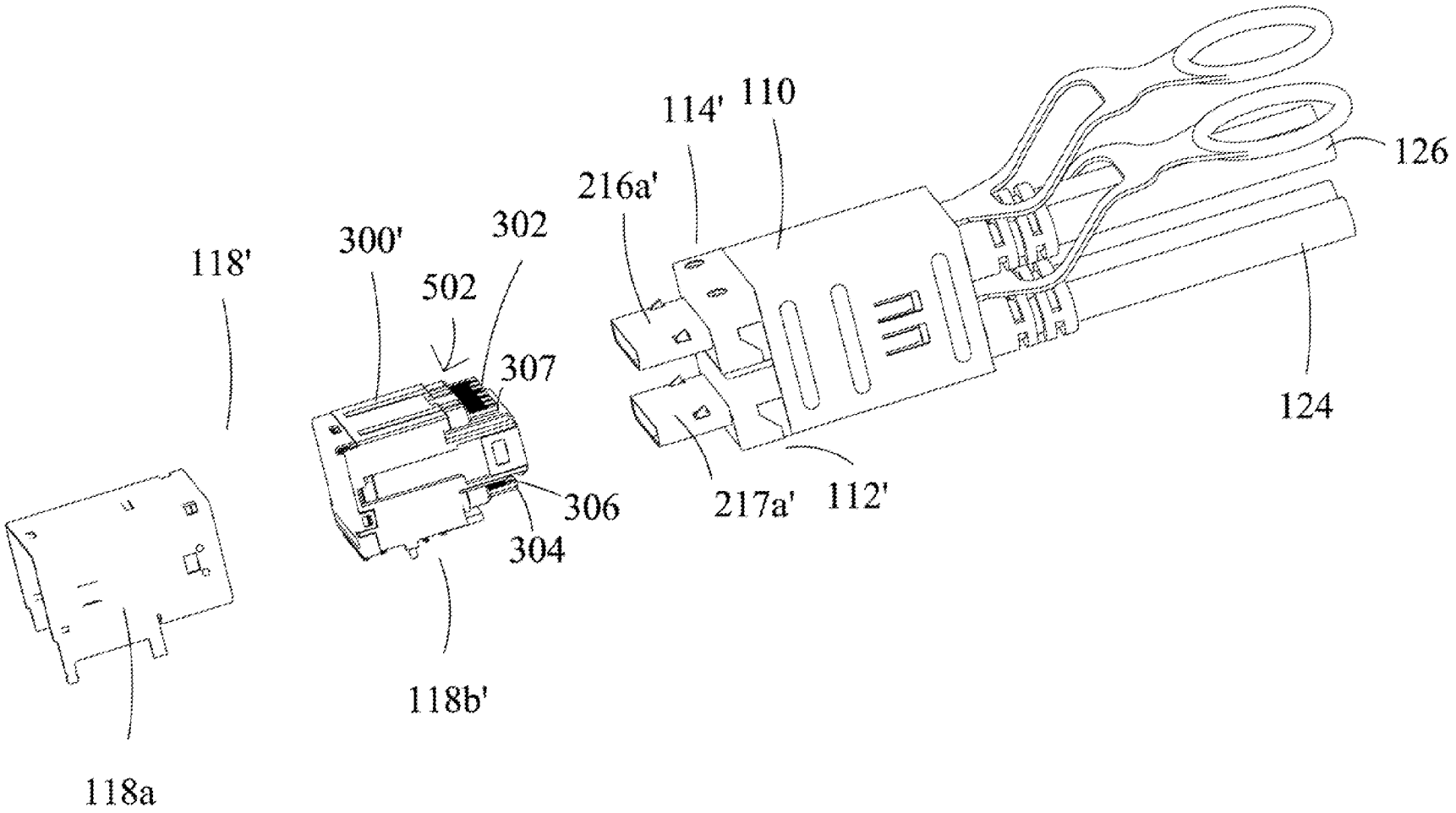
FIGS. 6A and 6B are exploded views and sectional views of the receptacle structure of FIG. 5 and a plug connector with a longer metal case before mating.
Figure 6B:
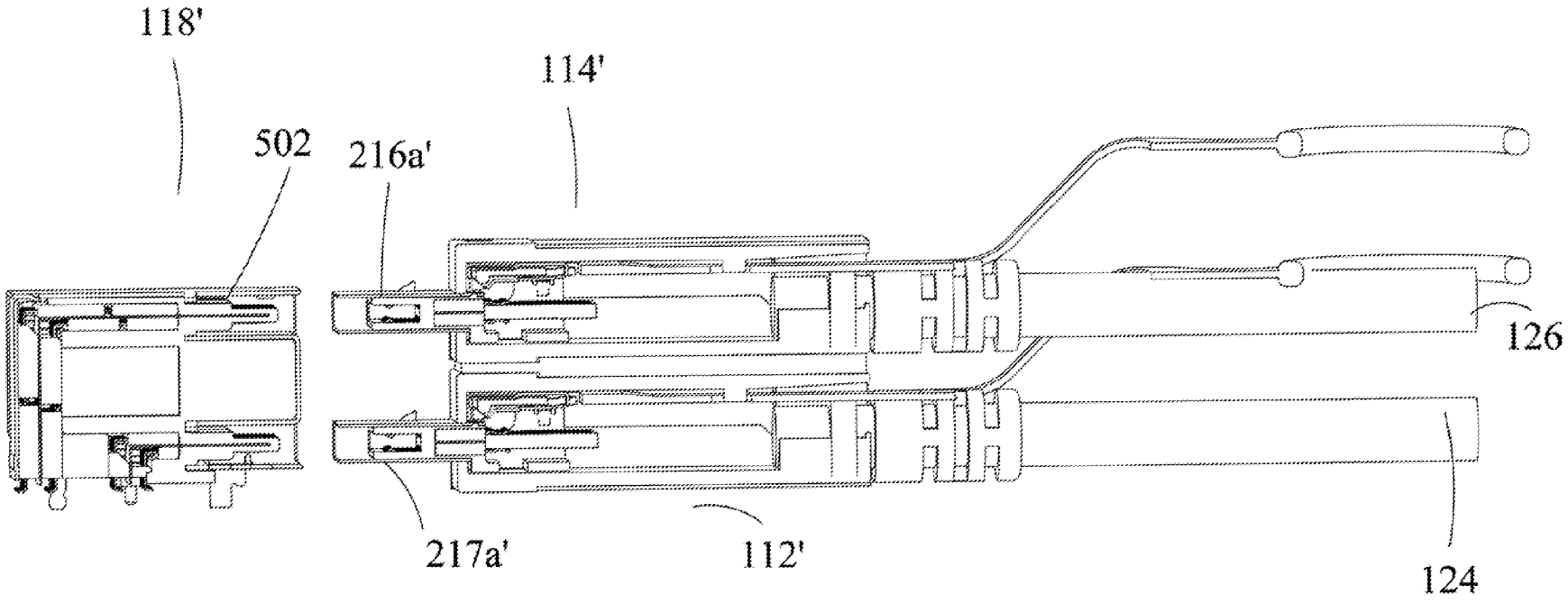
Figure 6C:
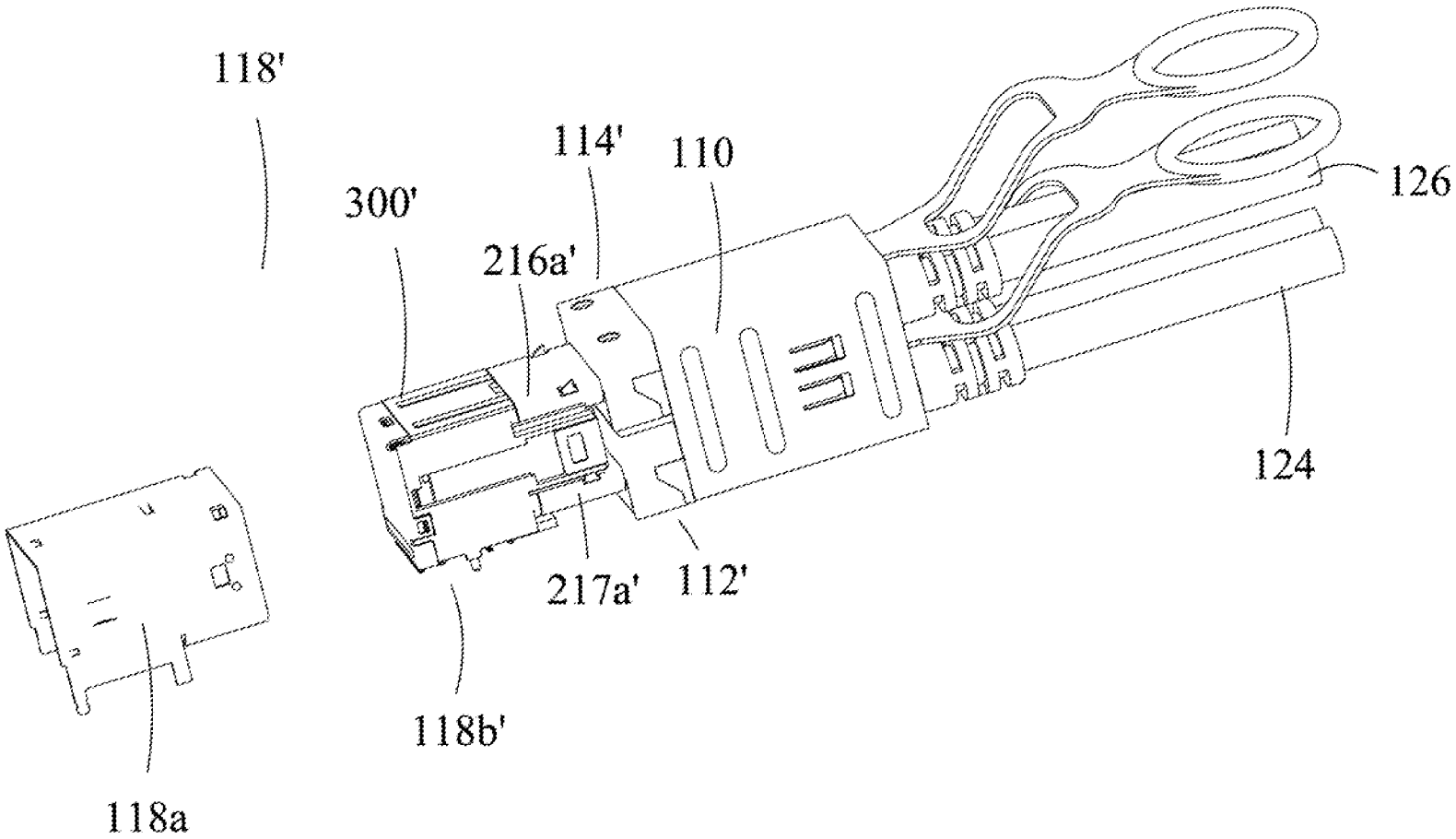
FIGS. 6C and 6D are exploded views and sectional views of the receptacle structure of FIG. 5 and the plug connector with the longer metal case of FIGS. 6A and 6B mated together.
Figure 6D:
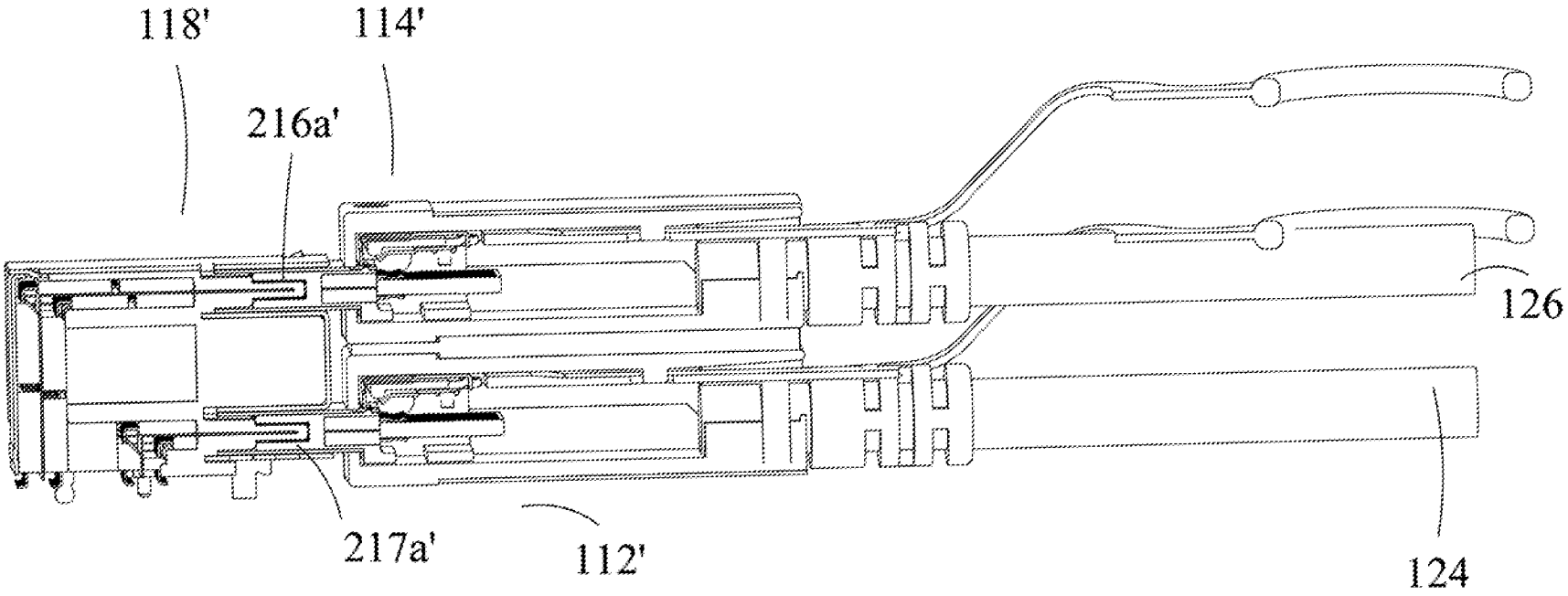

Please also refer to FIGS. 6A-6D. FIGS. 6A and 6B are exploded views and sectional views of the receptacle structure of FIG. 5 and a plug connector with a longer metal case before mating. FIGS. 6C and 6D are exploded views and sectional views of the receptacle structure of FIG. 5 and the plug connector with the longer metal case of FIGS. 6A and 6B mated together. As shown in FIGS. 5 and 6A-6D, in the present disclosure, a circumferential gap 502 is formed by an excavation of a part of the plastic material of the plastic base 300' of the connector body 118*b*' of the receptacle connector 118' near a region in the vicinity of the tongue plate 302, 304, so as to define an accommodation space to accommodate the mating heads 216*a*', 217*a*' of the elongated plug connectors 112', 114'. Therefore, the receptacle connector 118' of the present disclosure can be mated with the elongated plug connectors 112', 114'.

Figure 7A:
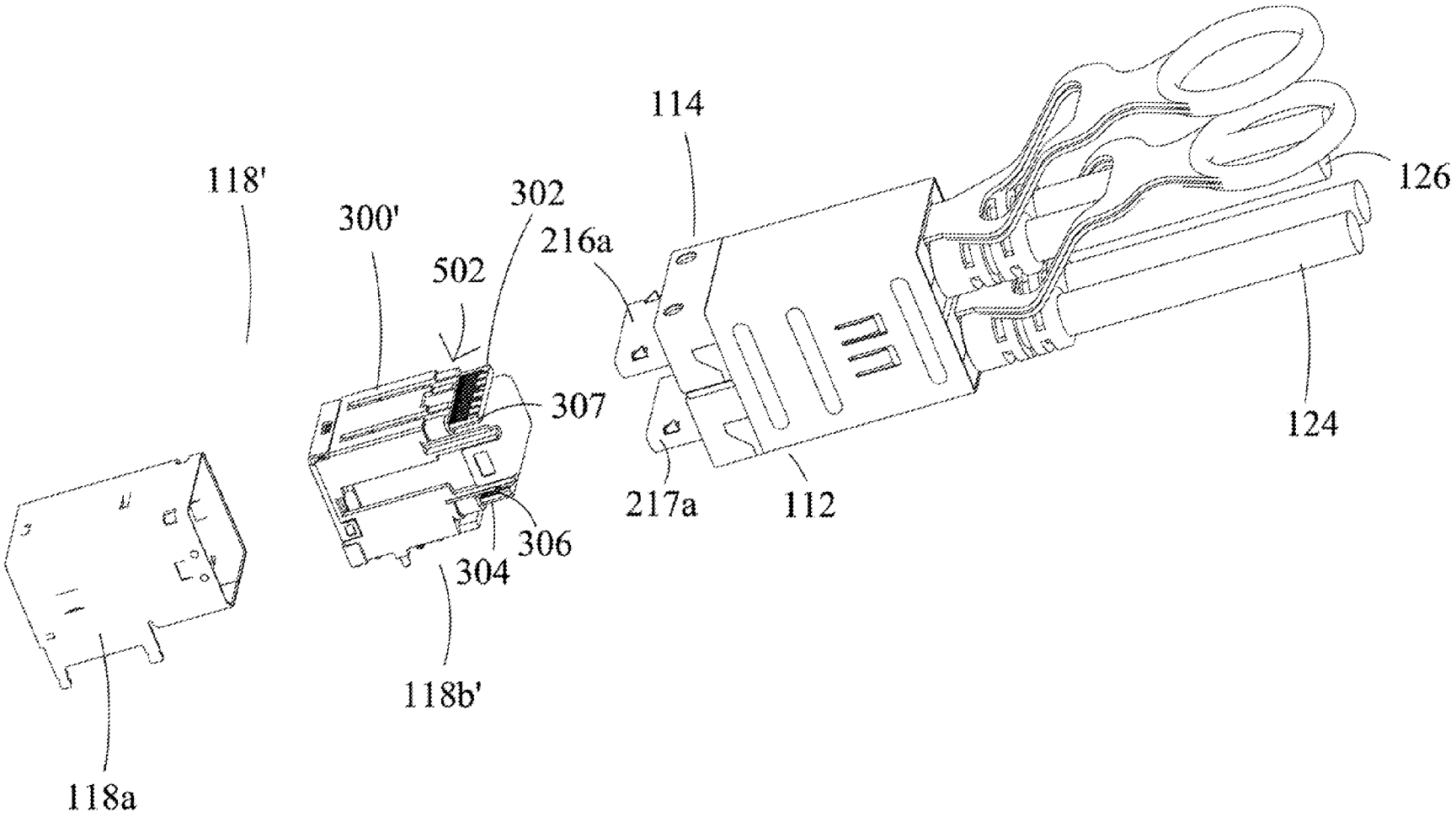
FIGS. 7A and 7B are exploded views and sectional views of the receptacle structure of FIG. 5 and a plug connector with a standard metal case before mating.
Figure 7B:
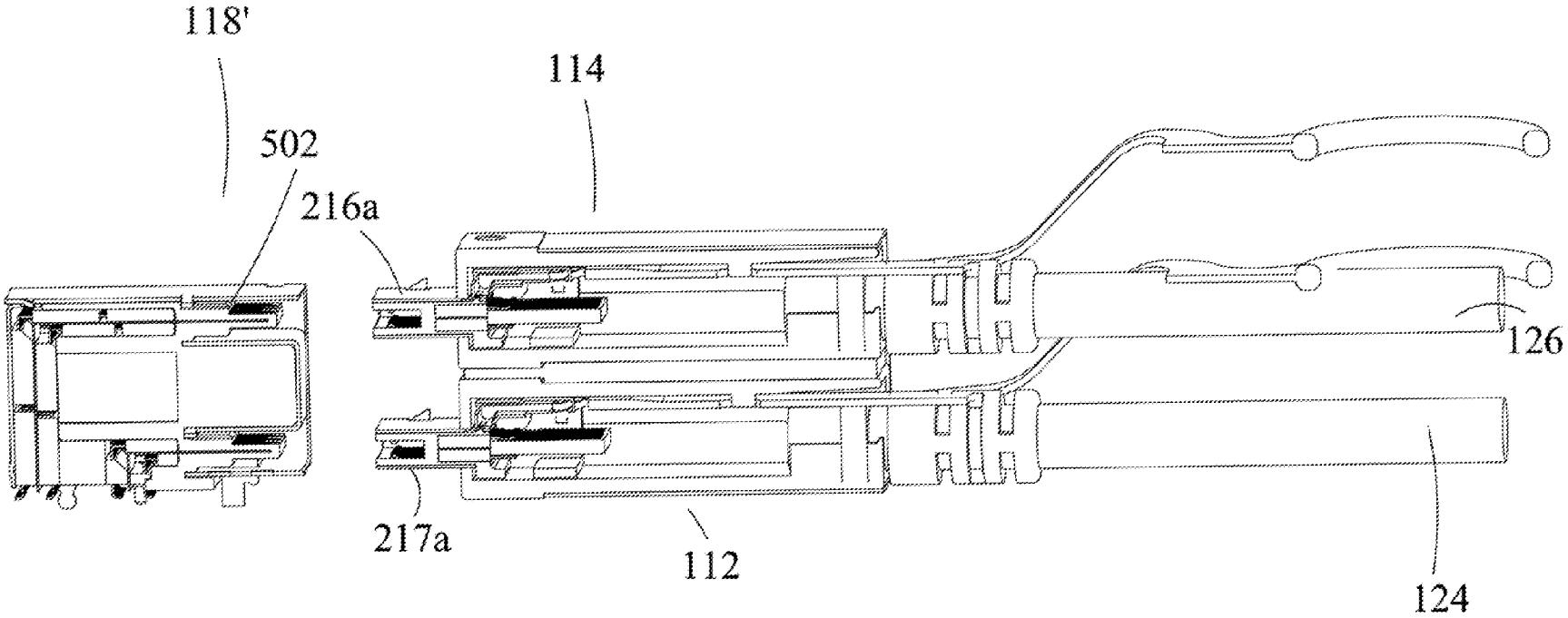
Figure 7C:
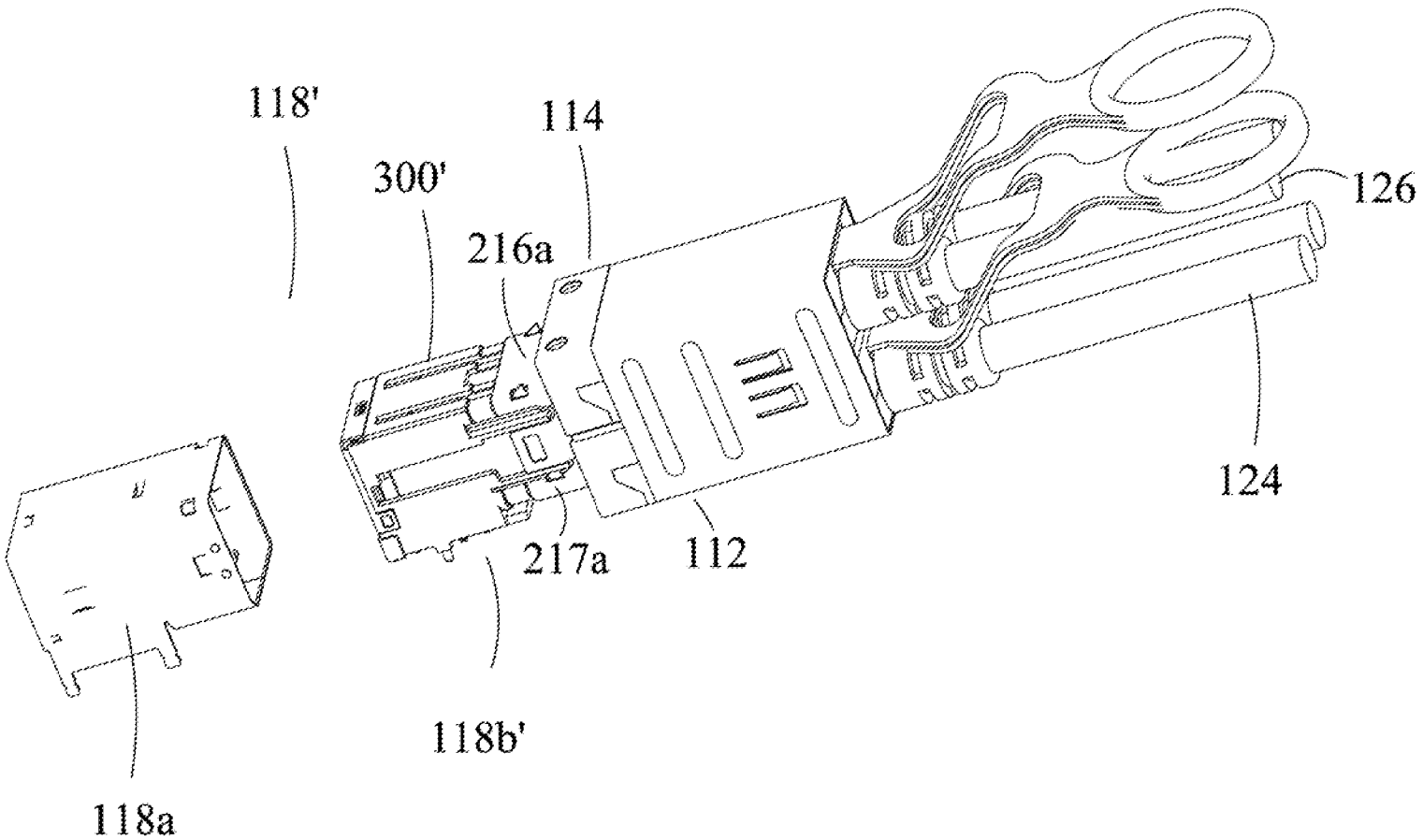
FIGS. 7C and 7D are exploded views and sectional views of the receptacle structure of FIG. 5 and the plug connector with the standard metal case of FIGS. 7A and 7B mated together.
Figure 7D:
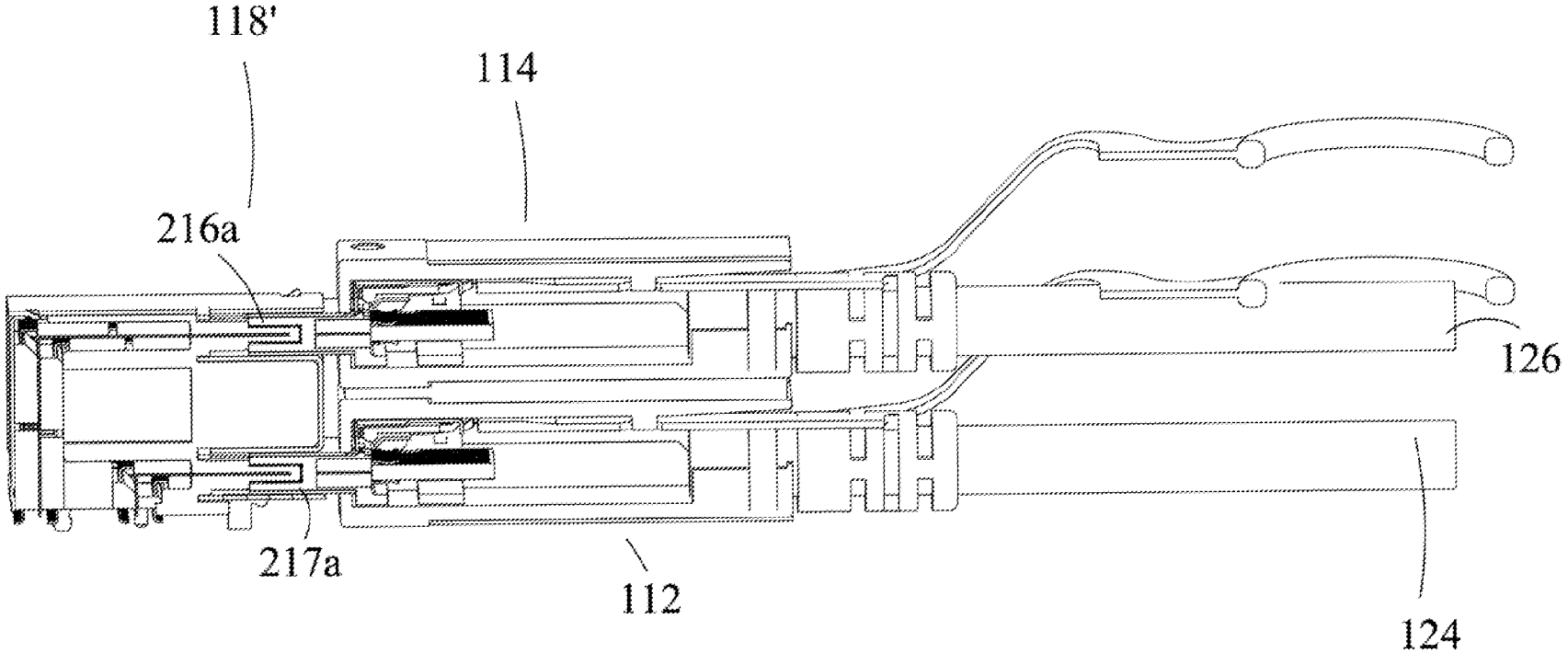

Please also refer to FIGS. 7A-7D. FIGS. 7A and 7B are exploded views and sectional views of the receptacle structure of FIG. 5 and a plug connector with a standard metal case before mating. FIGS. 7C and 7D are exploded views and sectional views of the receptacle structure of FIG. 5 and the plug connector with the standard metal case of FIGS. 7A and 7B mated together. As shown in FIGS. 5 and 7A-7D, when the receptacle connector 118' of the present disclosure and the standard plug connectors 112, 114 are mated, through the snapping of the of the groove 307 on a side of the tongue plate 302 and a corresponding groove (not shown) on a side of the insulating housing of the standard plug connectors 112, 114, the mating heads 216*a*, 217*a* abut against or approach the boundary surface between the plastic base 300 and the tongue plates 302, 304. Therefore, the receptacle connector 118' of the present disclosure can be mated with the standard plug connectors 112, 114.

Moreover, various changes of the embodiments above are allowed. For example, the plug connectors can compose of the standard plug connector 112 and the elongated plug connector 114', or the elongated plug connector 112' and the standard plug connector 114. However, no matter the composition of the plug connectors, the receptacle connector of the present disclosure can be freely mated with the stand plug connector or the elongated plug connector. Therefore, the present disclosure provides a receptacle connector capable of mating with plug connectors with mating heads with different lead-in lengths. In this manner, the receptacle connector can be applied inside a computer mating with the standard plug connector, or outside a computer mating the elongated plug connector.

Although the present disclosure has been described in considerable detail with reference to certain embodiments thereof, other embodiments are possible. Therefore; the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A receptacle connector, comprising:

a connector body at least suitable to mate with a first plug connector, the first plug connector having an insulating housing and a metal case, the metal case encompassing the outside of the insulating housing, and the metal case being made of a metallic material, wherein the connector body comprises:

a plurality of metal terminals; and a plastic base comprising at least a tongue plate for the metal terminals to interpose therein;

wherein the plastic base forms a recess near the tongue plate, the recess defines an accommodation space, when the receptacle connector and the first plug connector are mated, the metal case at least partially encompasses the outside of the tongue plate; and when the receptacle connector and a second plug connector with a metal case longer than the metal case of the first plug connector are mated, the metal case of the second plug connector is at least partially accommodated in the recess.

2. The receptacle connector of claim 1, wherein the recess is formed by an excavation of a part of a plastic material of the plastic base near the tongue plate.

3. The receptacle connector of claim 1, wherein a length of the recess along a direction that the first plug connector is mated with the receptacle connector is a difference between a lead-in length of the metal case of the second plug connector and a lead-in length of the metal case of the first plug connector.

* * * * *